US011825281B1

(12) United States Patent
Chiu et al.

(10) Patent No.: US 11,825,281 B1
(45) Date of Patent: Nov. 21, 2023

(54) ADAPTIVE EQUALIZATION COMPENSATION FOR EARBUDS

(71) Applicant: Apple Inc., Cupertino, CA (US)

(72) Inventors: Victoria Chiu, Emerald Hills, CA (US); Martin Kuster, Los Gatos, CA (US); Tom-Davy W. Saux, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 119 days.

(21) Appl. No.: 17/484,795

(22) Filed: Sep. 24, 2021

(51) Int. Cl.
*H04R 3/04* (2006.01)
*G10K 11/178* (2006.01)
*H04R 1/10* (2006.01)

(52) U.S. Cl.
CPC ..... *H04R 3/04* (2013.01); *G10K 11/17885* (2018.01); *G10K 2210/1081* (2013.01); *H04R 1/1016* (2013.01)

(58) Field of Classification Search
None
See application file for complete search history.

(56) References Cited

U.S. PATENT DOCUMENTS 5,792,073 A 8/1998 Keefe
8,182,431 B2 5/2012 Allen et al.
8,241,224 B2 8/2012 Keefe
9,516,407 B2 12/2016 Goldstein et al.
2010/0329481 A1* 12/2010 Fukuda ..... H04R 1/1083 381/94.1
2011/0144529 A1 6/2011 Perez-Abalo et al.
2014/0044275 A1* 2/2014 Goldstein ..... H04R 1/1083 381/71.6
2014/0093090 A1 4/2014 Bajic et al.
2014/0321657 A1* 10/2014 Stirnemann ..... H04R 25/606 381/60
2020/0304936 A1* 9/2020 Chen ..... H04S 7/307

OTHER PUBLICATIONS

Kohler, Simon, et al., "A comparison of methods for estimating individual real-ear-to-coupler-differences (RECDs) in hearing aid fitting," Proceedings of Meetings on Acoustics, Acoustical Society of America, vol. 19, Jun. 2, 2013, 10 pages.
(Continued)

*Primary Examiner* — James K Mooney
(74) *Attorney, Agent, or Firm* — Aikin & Gallant, LLP

(57) ABSTRACT

Disclosed are systems and methods for performing adaptive equalization operations to reduce variations in the frequency response of audio signals at the eardrum of a wearer of an earphone. The assumption that the frequency response of the error microphone matches the frequency response at the eardrum may not be true due to signal leakage effects and the shape of the ear canal. Techniques are disclosed for the adaptive equalization operations to perform a calibration algorithm to compensate for the effects of the signal leakage and the shape of the ear canal. The earphone may estimate the transfer function from the speaker to the error microphone and may estimate the load impedance from the earphone based on a calibrated relationship between the transfer function and the load impedance. The adaptive equalization may use a calibration algorithm to adjust the frequency response at the error microphone to match that at the eardrum.

20 Claims, 7 Drawing Sheets

(56) References Cited

OTHER PUBLICATIONS

"Tympanometry Machines," Middle Ear Tests, E3 Diagnostics, retrieved from the Internet <https://www.e3diagnostics.com/products/tympanometry—middle-ear-analyzers> on Jun. 25, 2021, 21 pages.
Stirnemann, A., et al., "A Network Model of the Middle Ear," Swiss Federal Institute of Technology, Feb. 1983, 3 pages.
"Middle-ear power analysis," Mimosa Acoustics, 2019, 4 pages.

* cited by examiner $$\frac{p_d}{p_e} = \frac{Z_{InputEar||Leak}}{Z_{InputEar||Leak} + R_{grill}}$$

ADAPTIVE EQUALIZATION COMPENSATION FOR EARBUDS

FIELD

This disclosure relates to the field of audio communication, including to digital signal processing techniques designed to reduce or minimize variations in frequency response of playback signals heard by wearers of personal audio output devices. Other aspects are also described.

BACKGROUND

Wearable audio output devices such as headphones, earbuds, earphones, etc., are widely used to provide music and other audio content to users, or when users are participating in telephony calls while minimizing disturbance to those nearby. Users may prefer the ultra-slim profile of in-ear devices such as earbuds, or the comfort of on-ear devices such as earphones or headphones. The frequency response of the audio signals may be influenced by leakage paths in the audio devices, the manner in which the devices are worn, and the different sizes or shapes of the wearers' ear canals and eardrums. For example, characteristics of the vents or openings on a device, characteristics of the parasitic leakage paths due to how loosely the device fits within a wearer's ear canal, and the contour of the ear canal through which the signal travels to the eardrum may cause variance in the frequency response of the audio signals heard by different wearers. It is desirable to reduce or mitigate variance in the frequency response of the audio signals to provide a more consistent media playback experience regardless of the fit of the audio device across all wearers or the characteristics of the ear canal and eardrum of the wearers.

SUMMARY

Disclosed are aspects of methods and systems for performing adaptive equalization operations to reduce or minimize variations in the frequency response of audio signals at the eardrum of a wearer of an in-ear or on-ear earphone. The earphone may use a sensor such as an error microphone as a proxy for the audio signals heard by the wearer due to the physical impossibility of measuring directly the audio signals impinging on the eardrum of the wearer. Adaptive equalization, which aim to provide a relatively uniform frequency response across the range of acoustic frequencies, operates on the signals captured by the error microphone based on the assumption that the frequency response of the error microphone matches the frequency response at the eardrum for low frequencies (e.g., <1 KHz). This assumption may not hold true due to signal leakage. For the frequency response at higher frequencies (e.g., >1 KHz), there may also be a mismatch between the error microphone and the eardrum due to the sensitivity of the response at the eardrum at this frequency to the shape of the ear canal and the eardrum of the wearer. Adaptive equalization operations thus may not provide the desired equalized signals at the eardrum. To reduce the mismatch in the frequency response of the audio signals between the eardrum and the error microphone, disclosed are techniques for the adaptive equalization operations to perform a calibration algorithm to compensate for the effects of the signal leakage and the shape of the ear canal. The adaptive equalization may use the calibration algorithm to adjust the frequency response at the error microphone to match that at the eardrum.

The signal leakage paths contributing to the leakage effects may include a signal propagation path across a housing mesh between the error microphone and the eardrum. The housing mesh is placed at the tip of the earphone to protect the earphone against environmental ingress. Leakage effects may also be due to parasitic leakage paths caused by an imperfect seal between the earphone and the ear canal of the wearer. The acoustic pressure drop across the housing mesh and the signal leakage from the various leakage paths may cause a mismatch in the frequency response between the error microphone and the eardrum for lower acoustic frequencies. For higher frequencies, the mismatch in the error microphone and eardrum responses may be dominated by the acoustic impedance of the ear canal and eardrum. Aspects of the disclosure estimate the mismatch due to the leakage effects and the ear canal to modify the operations of the adaptive equalization to provide a more uniform frequency response at the eardrum.

In one aspect, the earphone may estimate a transfer function in the frequency domain from a speaker driving the playback signal to the error microphone. The earphone may estimate the signal transfer function as part of the adaptive equalization loop that adaptively changes the gain of the playback signal driven from the speaker to equalize the frequency response of the playback signal measured at the error microphone. The signal transfer function at the error microphone may be a function of the leakage effects. The earphone may estimate characteristics of the signal leakage based on the estimated signal transfer function and a calibrated relationship between the characteristics of the signal leakage and the signal transfer function. In one aspect, the calibrated relationship may be obtained through offline measurements or simulations. In one aspect, the signal leakage characteristics may include the acoustic impedance due to the various leakage paths and the calibrated relationship may include effects of the acoustic impedance of the leakage paths on the signal transfer function at the error microphone. Based on the estimated characteristics of the signal leakage such as the impedance of the leakage paths and a model of the leakage effects on the signal received by the eardrum, the earphone may estimate the frequency response of the signal at the eardrum.

In one aspect, the model of the leakage effects on the signal at the eardrum may model the relationship between the acoustic pressure of the signal at the eardrum relative to the acoustic pressure of the signal at the error microphone. The acoustic pressure at the eardrum may be less than at the error microphone due to the pressure drop across the housing mesh and the parasitic leakage paths for low frequencies. In one aspect, the earphone may estimate the difference in the acoustic pressure between the error microphone and the eardrum based on the estimated load impedance encountered by the acoustic pressure of the signal from the earphone and the acoustic impedance of the housing mesh. The load impedance may include the acoustic impedance of the leakage paths, the ear canal and the eardrum for the high frequencies. The earphone may adjust the signal transfer function measured at the error microphone to compensate for the mismatch in the acoustic pressure between the error microphone and the eardrum. The adaptive equalization may use the adjusted signal transfer function to effectively equalize the playback signal at the eardrum. In effect, a "virtual" microphone located at the eardrum may be implemented by the adaptive equalization to reduce or minimize the variance in the frequency response at the eardrum for different leakage effects.

In one aspect, a method for frequency equalization using impedance calibration to compensate for the mismatch in the frequency response at the eardrum and at the error microphone due to signal leakage effects in an earphone is disclosed. The method may include estimating a transfer function of a signal path from a speaker to an error microphone of the earphone. The method may also include estimating an acoustic load impedance encountered by the acoustic pressure from the earphone based on the transfer function of the path and a calibrated relationship between the transfer function of the path and the load impedance. The method further includes determining a relationship between the acoustic pressure at the error microphone and the acoustic pressure at the eardrum of a wearer of the earphone based on the estimated load impedance. The method further includes adjusting the transfer function of the path based on the relationship between the acoustic pressure at the error microphone and the acoustic pressure at the eardrum to compensate for the difference in the acoustic pressure. The method further includes running the acoustic equalization to adaptively change the gain of the playback signal driven to the speaker based on the adjusted transfer function of the path.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

Several aspects of the disclosure here are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

Figure 1:
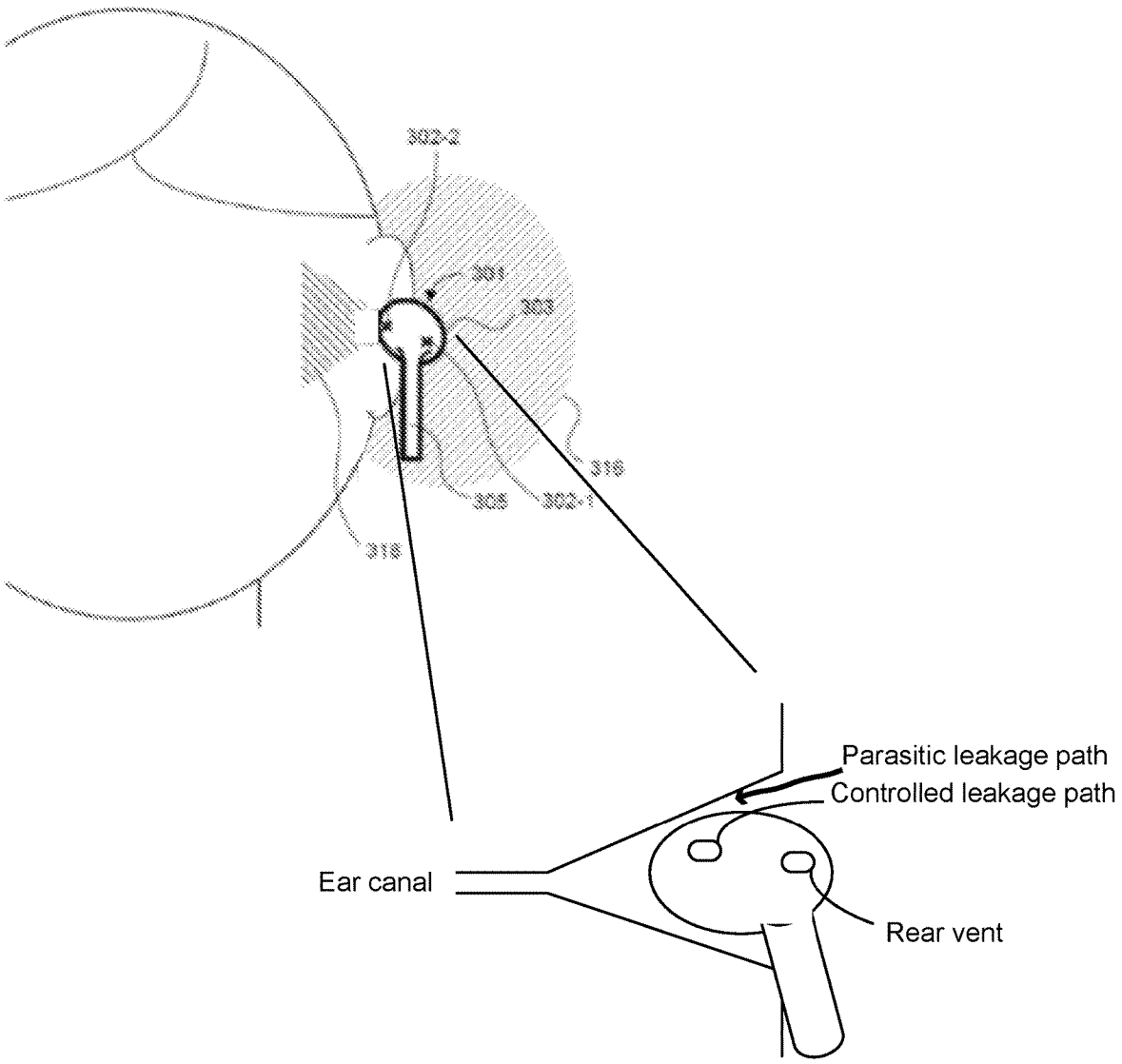
FIG. 1 depicts use of an earphone in which playback signal may leak out or ambient sound may leak in or through a rear vent, a controlled leakage path, or the passive isolation formed between the earphone and the ear canal of a user according to one aspect of the disclosure.

Wearable audio output devices (e.g., in-ear headphones or earbuds, over-the-ear headsets, etc.), which may be collectively referred to as earphones, may operate in a number of different modes. In one mode, when an earphone is streaming media content or used in voice communication, the earphone may implement an adaptive equalization operation to shape the audio signal, also referred to as the playback signal, projected to the wearer of the earphone. The earphone may include an integrated error microphone positioned in front of the speaker to measure the frequency response of the playback signal as an approximation of the frequency response at the eardrum of the wearer. Based on the measured frequency response at the error microphone, the adaptive equalization operation may adaptively change the gain of the audio signal to provide a relatively uniform frequency response for the wearer. Due to signal leakage effects, the frequency response of the signal at the error microphone for low frequencies (e.g., <1 KHz) may not be a good approximation of the frequency response of the signal at the eardrum.

The leakage effects may be manifested as a drop in the acoustic pressure impinging on the eardrum compared to the acoustic pressure measured at the error microphone. For example, the acoustic pressure of the playback signal may drop across a housing mesh at the tip of the earphone when the signal propagates from the earphone into the ear canal of the wearer. There may also be loss of acoustic pressure due to controlled leakage paths on the earphone or parasitic leakage paths attributed to the loose fitting of the earphone within the ear canal or the shape of the ear canal. The leakage effects may be characterized using acoustic impedance. For example, the leakage effects may be characterized based on the acoustic impedance of the housing mesh and the acoustic load impedance seen by the earphone. The acoustic load impedance seen by the earphone, which may be referred to simply as the load impedance or input impedance, may be modeled as the impedance encountered by the acoustic pressure of the signal propagating into the ear canal from the earphone and may include the acoustic impedance of the parasitic leakage paths and the ear canal.

In one aspect, the ratio of the acoustic pressure of the signal at the eardrum over that at the error microphone for low frequencies may be modeled as a ratio of the load impedance over the sum of the load impedance and the acoustic impedance of the housing mesh. The load impedance for low frequencies may be dominated by the acoustic impedance of the parasitic leakage paths. In one aspect, the ratio of the acoustic pressure of the signal at the eardrum over that at the error microphone for high frequencies may take into the account the acoustic impedance of the ear canal and the eardrum. The load impedance for high frequencies may be dominated by the impedance of the ear canal and the eardrum. By estimating the load impedance and with prior knowledge of the acoustic impedance of the housing mesh, the earphone may estimate the ratio of the acoustic pressure of the signal at the eardrum over the error microphone across the range of acoustic frequencies. This ratio may be less than one due to the leakage effects and may be used as a measure of the mismatch in the frequency response between the eardrum and the error microphone. Based on the mismatch in the frequency response between the eardrum and the error microphone, the earphone may adjust the adaptive equalization operation to compensate the measured frequency response at the error microphone to match the estimated frequency response at the eardrum. The effect may be to advantageously provide a more uniform frequency response at the eardrum from the adaptive equalization operations across a range of leakage effects.

In one aspect, the earphone may estimate the load impedance based on the measured transfer function of the signal from the speaker to the error microphone as part of the gain adaptation loop of the adaptive equalization operations. The transfer function, also referred to as the secondary transfer function varies as a function of the leakage effects and thus varies as a function of the load impedance seen by the earphone. The relationship between the secondary transfer function and the load impedance may be calibrated through offline measurements or simulations such as during product development, in a power-up cycle, before activating the adaptive equalization, etc. Based on the calibrated relationship, the earphone may estimate the load impedance from the measured secondary transfer function during online operation of the adaptive equalization. For load impedance in the low frequencies that are dominated by the impedance of the parasitic leakage paths, the estimated load impedance may be used as an approximation of the impedance of the parasitic leakage paths. For load impedance in the high frequencies that are dominated by the impedance of the ear canal and the eardrum, the estimated load impedance may be used as an approximation of the impedance of the ear canal and the eardrum. Using the estimated load impedance of the parasitic leakage paths, the ear canal and the eardrum, the earphone may estimate the ratio of the acoustic pressure of the signal at the eardrum over the error microphone. The adaptive equalization operations may then adaptively adjust the gain adaption loop to compensate the frequency response at the eardrum to match the frequency response at the error microphone In the following description, numerous specific details are set forth. However, it is understood that aspects of the disclosure here may be practiced without these specific details. In other instances, well-known circuits, structures and techniques have not been shown in detail in order not to obscure the understanding of this description.

The terminology used herein is for the purpose of describing particular aspects only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the elements or features in use or operation in addition to the orientation depicted in the figures. For example, if a device containing multiple elements in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and "comprising" specify the presence of stated features, steps, operations, elements, or components, but do not preclude the presence or addition of one or more other features, steps, operations, elements, components, or groups thereof.

The terms "or" and "and/or" as used herein are to be interpreted as inclusive or meaning any one or any combination. Therefore, "A, B or C" or "A, B and/or C" mean any of the following: A; B; C; A and B; A and C; B and C; A, B and C." An exception to this definition will occur only when a combination of elements, functions, steps or acts are in some way inherently mutually exclusive.

FIG. 1 depicts use of an earphone in which playback signal may leak out or ambient sound may leak in or through a rear vent, a controlled leakage path, or the passive isolation formed between the earphone and the ear canal of a user according to one aspect of the disclosure. The earphone 301 includes an earbud 303 and stem 305. The earphone 301 is worn by the user such that earbud is in the user's left ear. When earbud 303 is inserted into the user's ear, a seal may be formed between earbud 303 and the user's ear canal so as to partially isolate the user's ear canal from the surrounding physical environment. For example, earbud 303 may block some but not necessarily all of the playback signal from leaking out of the ear canal, or conversely may allow some of the ambient sound in the surrounding physical environment to reach the user's ear canal. In other use cases, the playback signal may leak through a controlled leakage path used to reduce the occlusion effect of the earphone or to provide a more consistent bass response across users.

A first microphone or a first array of microphones 302-1 is located externally on earphone 301 to capture the ambient sound that may emanate from region 316 of the surrounding physical environment for processing as a reference signal by an acoustic noise cancellation (ANC) operation. A second microphone or a second array of microphones 302-2 is located inside the housing of earphone 301 to act as an error microphone to capture the playback signal for adaptive equalization or to detect the residual noise signal for the ANC operation. The error microphone may be used as a proxy for the sound heard by the eardrum. In one aspect, the error microphone may be used to capture the near-field speech signal of the user. The playback signal maybe projected by a speaker (not shown) of earphone 301 into a region 318 inside the user's ear canal. A magnified view of earphone 301 shows that the playback signal may leak from the ear canal from multiple paths such as through a rear vent on the exteriorly exposed side of earbud 303 in addition to the leakage through the imperfect seal between the earbud 303 and the ear canal. This leakage due to the imperfect seal may be referred to as a parasitic leakage path. The playback signal may also leak through a controlled leakage path near the tip of ear-phone 301. In one aspect, the leakage through the controlled leakage path may dominate over the leakage through the rear vent and may be comparable to the parasitic leakage due to the imperfect seal of the earphone 301 against the ear canal when earphone 301 is loosely worn.

Figure 2:
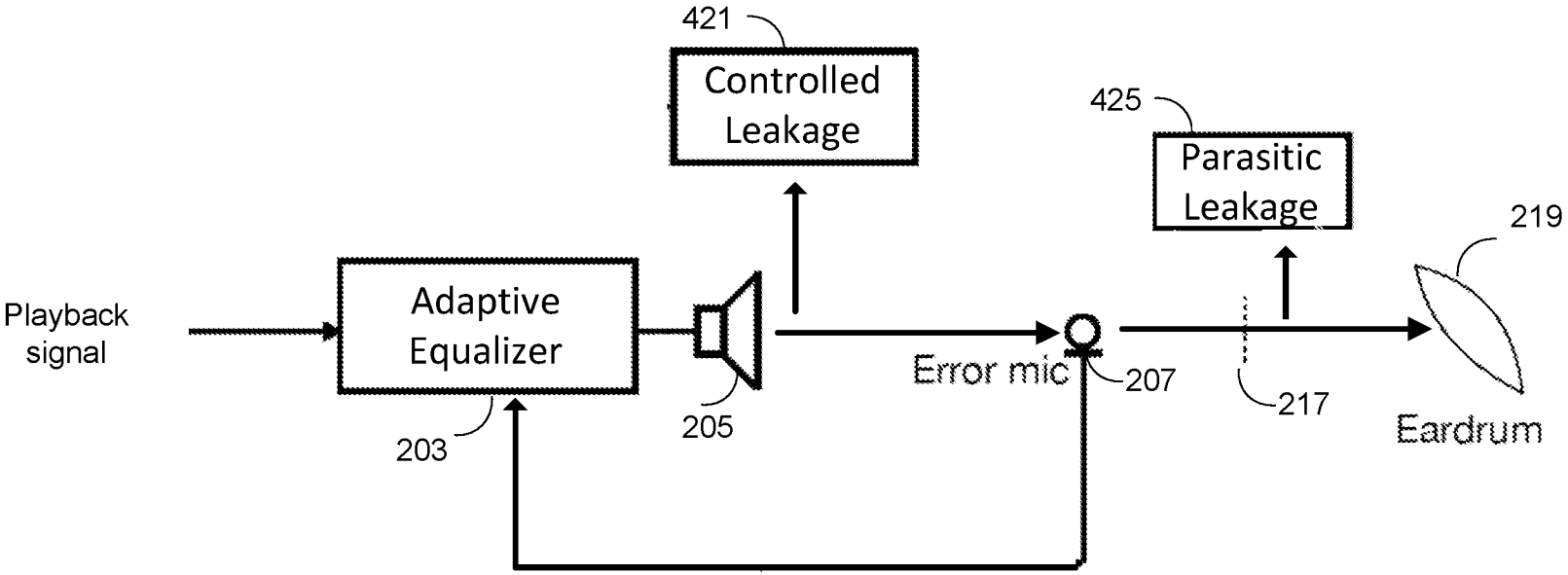
FIG. 2 depicts an acoustic propagation model of the playback signal from the adaptive equalization leaking through the parasitic leakage path and the controlled leakage path of an earphone and the partial loss of the acoustic pressure of the playback signal across a housing mesh between the error microphone and the eardrum according to one aspect of the disclosure.

FIG. 2 depicts an acoustic propagation model of the playback signal from the adaptive equalization leaking through the parasitic leakage path and the controlled leakage path of an earphone and the partial loss of the acoustic pressure of the playback signal across a housing mesh between the error microphone and the eardrum according to one aspect of the disclosure.

An adaptive equalizer 203 may receive the playback signal to shape the playback signal to compensate for the variance in the frequency response of the conductive channel through which the playback signal propagates from the earphone to the eardrum. The playback signal may represent streaming media content for playback, responses from voice queries, voice communication signals of remote parties in telephony or video calls, etc. Adaptive equalizer 203 attempts to equalize the frequency response of the conductive channel across the range of audio frequencies so that the spectral content of the playback signal as heard by the wearer of the earphone is substantially the same as the spectral content of the playback signal received by the earphone. In one aspect, adaptive equalizer 203 may filter the playback signal to adjust its gain as a function of the frequency. Adaptive equalizer 203 drives a speaker 205 to propagate the gain-adjusted playback signal through the ear canal of the wearer of the earphone.

An error microphone 207 acting as a proxy for eardrum 219 captures the playback signal projected from speaker 205 to approximate the playback signal at the eardrum of the wearer. Error microphone 207 feeds back the captured playback signal as part of the control loop for adaptive equalizer 203 to adaptively adjust the gain of the playback signal across the range of audio frequencies in response to a change in the frequency response of the conductive path from speaker 205 to error microphone 207. The frequency response of the conductive path from speaker 205 to error microphone 207, referred to as the secondary transfer function, may vary due to the leakage effects. In addition, the leakage effects and the shape of the ear canal of the wearer may reduce the acoustic pressure of the playback signal at eardrum 219 compared to the acoustic pressure of the playback signal at error microphone, causing a mismatch in the frequency response of the playback signal at error microphone 207 and at eardrum 219.

The leakage effects may be due to multiple leakage paths for the playback signal projected from speaker 205. One leakage path may be via a rear vent or a controlled leakage path 421 on the housing of the earphone. The playback signal may also leak from the ear canal through the seal between the earphone and the ear canal in a parasitic leakage path 425. When the playback signal propagates through the housing mesh 217 at the tip of the earphone into the ear canal, the resistivity of mesh 217 compared to the impedance of the propagation path to eardrum 219 may cause a pressure drop of the playback signal across mesh 217. The transfer function of the propagation path of the playback signal from speaker 205 to eardrum 219 may thus be different from transfer function of the propagation path of the playback signal from speaker 205 to error microphone 207.

Figure 3:
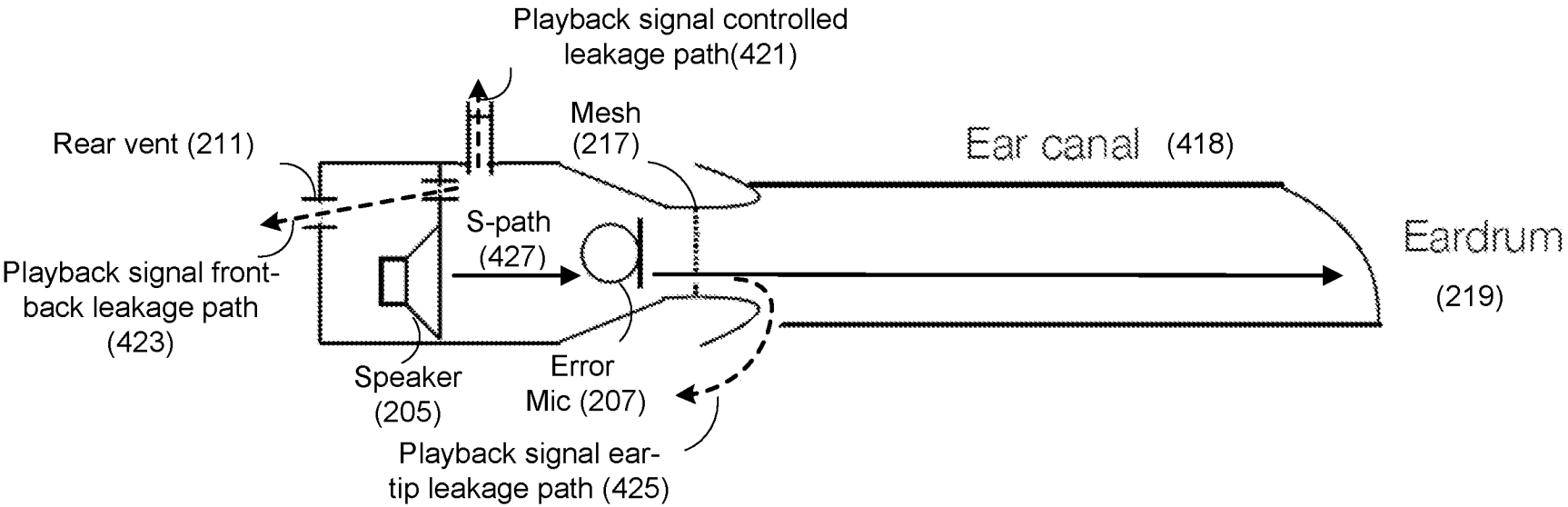
FIG. 3 depicts how the multiple leakage paths of the playback signal and the partial loss of the acoustic pressure of the playback signal due to the mesh may affect the playback signal at the eardrum according to one aspect of the disclosure.

FIG. 3 depicts how the multiple leakage paths of the playback signal and the partial loss of the acoustic pressure of the playback signal due to the mesh may affect the playback signal at the eardrum according to one aspect of the disclosure. The playback signal projected from speaker 205 may leak through a front-back leakage path 423 via rear vent 211. The playback signal may also leak from ear canal 418 through a parasitic leakage path 425 via a gap in the seal between the earphone and ear canal 418 or through a controlled leakage path 421. The playback signal may experience a partial pressure drop across mesh 217 due to resistivity of mesh 217 compared to the impedance of the propagation path to eardrum 219. In one aspect, the partial loss of the acoustic pressure of the anti-noise due to mesh 217 may be comparable to the pressure loss due to the parasitic leakage path 425 and may dominate over the pressure loss due to the other leakage paths. FIG. 3 also shows the secondary path 427 from speaker 205 to error microphone 207. Due to the leakage paths and the pressure drop across mesh 217, there is a mismatch in the frequency response of the playback signal at error microphone 207 and at eardrum 219.

The acoustic pressure at the eardrum and the acoustic pressure at the error microphone of an earphone is a function of the acoustic impedance introduced by the mesh, parasitic leakage paths, the ear canal, and the eardrum. The acoustic impedance encountered by the acoustic signal propagating into the ear canal from the earphone may include the impedance of a housing mesh at the tip of the earphone (e.g., mesh 217 of FIG. 2 and FIG. 3) and the load impedance seen by the earphone. The load impedance may include the impedance of the parasitic leakage path (e.g., parasitic leakage path 425 of FIG. 3), the impedance of the ear canal, and the impedance of the eardrum.

In one aspect, for a signal of low frequencies (e.g., <1 KHz), the load impedance $Z_{ld}$ may be dominated by the parasitic leakage path. In one aspect, the ratio between the acoustic pressure of the signal at the eardrum over that at the error microphone for low frequencies may be approximated by a ratio of the impedance of the parasitic leakage path over the sum of the impedance of the parasitic leakage path and the impedance of the mesh. By estimating the load impedance using low frequency signals and using it as an estimate of the impedance of the parasitic leakage path along with prior knowledge of the impedance of the mesh, the earphone may calculate the difference in the acoustic pressure of the signal at the eardrum and the error microphone for low frequency signals. The earphone may interpret this difference as a mismatch in the frequency response of the signals at the eardrum and at the error microphone at low frequencies. The earphone may then adjust the adaptive equalization operation to compensate the measured frequency response at the error microphone to match the estimated frequency response at the eardrum.

In one aspect, for a signal of high frequencies (e.g., >1 KHz), the load impedance may be dominated by the impedance of the ear canal and the impedance of the parasitic leakage path may be neglected. By estimating the load impedance using high frequency signals and neglecting the impedance of the parasitic path, the earphone may calculate the difference in the acoustic pressure of the signal at the eardrum and the error microphone for high frequency signals. The earphone may interpret this difference as a mismatch in the frequency response of the signals at the eardrum and at the error microphone at high frequencies. Again, the earphone may then adjust the adaptive equalization operation to compensate the measured frequency response at the error microphone to match the estimated frequency response at the eardrum.

Figure 4:
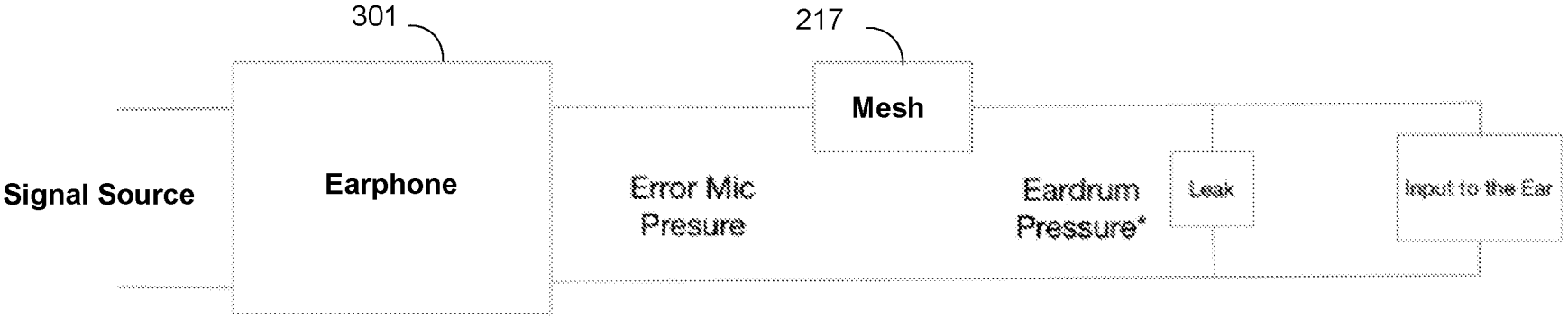
FIG. 4 depicts a simplified model approximating the acoustic pressure at the eardrum and the acoustic pressure at the error microphone for low frequency signals when the acoustic impedance is dominated by the parasitic leakage paths according to one aspect of the disclosure.

FIG. 4 depicts a simplified model approximating the acoustic pressure at the eardrum and the acoustic pressure at the error microphone for low frequency signals when the acoustic impedance is dominated by the parasitic leakage path according to one aspect of the disclosure. FIG. 4 may represent a simplification of a model in which the load impedance from the earphone is represented as a parallel connection of the impedance of the parasitic leakage path and the impedance of the ear canal.

An earphone 301 receives signals from a signal source to drive a playback signal from a speaker into the ear canal of a wearer of earphone 301. The acoustic pressure of the playback signal may be received by the error microphone and may also propagate through mesh 217 at the tip of earphone 301 into the ear canal. The acoustic pressure of the playback signal may experience a pressure drop when it crosses mesh 217. The impedance of mesh 217 is denoted as $R_{grill}$. In one aspect, $R_{grill}$ may be calculated from mesh resistance and area, or measured during product development. The load impedance $Z_{ld}$ seen by earphone 301 is denoted as $Z_{inputEar||Leak}$ to represent the parallel connection of $Z_{ec}$, the impedance of the ear canal, and $Z_{pl}$, the impedance of the parasitic leakage path. In one aspect, $Z_{inputEar||Leak}$ may be expressed as:

$$\frac{1}{Z_{ld}} = \frac{1}{Z_{pl}} + \frac{1}{Z_{ec}} \quad \text{(Eq. 1)}$$

In one aspect, the impedance of the parasitic leakage path $Z_{pl}$ may be estimated from the load impedance $Z_{ld}$ using low frequency signals as discussed. In one aspect, the impedance of the ear canal $Z_{ec}$ may be estimated from the load impedance $Z_{ld}$ using high frequency signals or from compliance model of ear canal.

In one aspect, the ratio of the acoustic pressure at the eardrum $P_{dr}$ and at the error microphone Per may be expressed as:

$$\frac{P_{dr}}{P_{er}} = \frac{Z_{inputEar||Leak}}{Z_{inputEar||Leak} + R_{grill}} \quad \text{(Eq. 2)}$$

Eq. 2 but shows that relationship between the acoustic pressure at the eardrum $P_{dr}$ and the acoustic pressure at the error microphone Per for low frequency signals may be interpreted as a pressure divider network (analogous to a voltage divider network) based on the pressure (or voltage in the analogous voltage divider network) across the load impedance and the pressure (or voltage) drop across mesh 217. In one aspect, the earphone may estimate the load impedance based on the measured transfer function of the signal from the speaker to the error microphone as part of the gain adaptation loop of the adaptive equalization operations.

Figure 5:
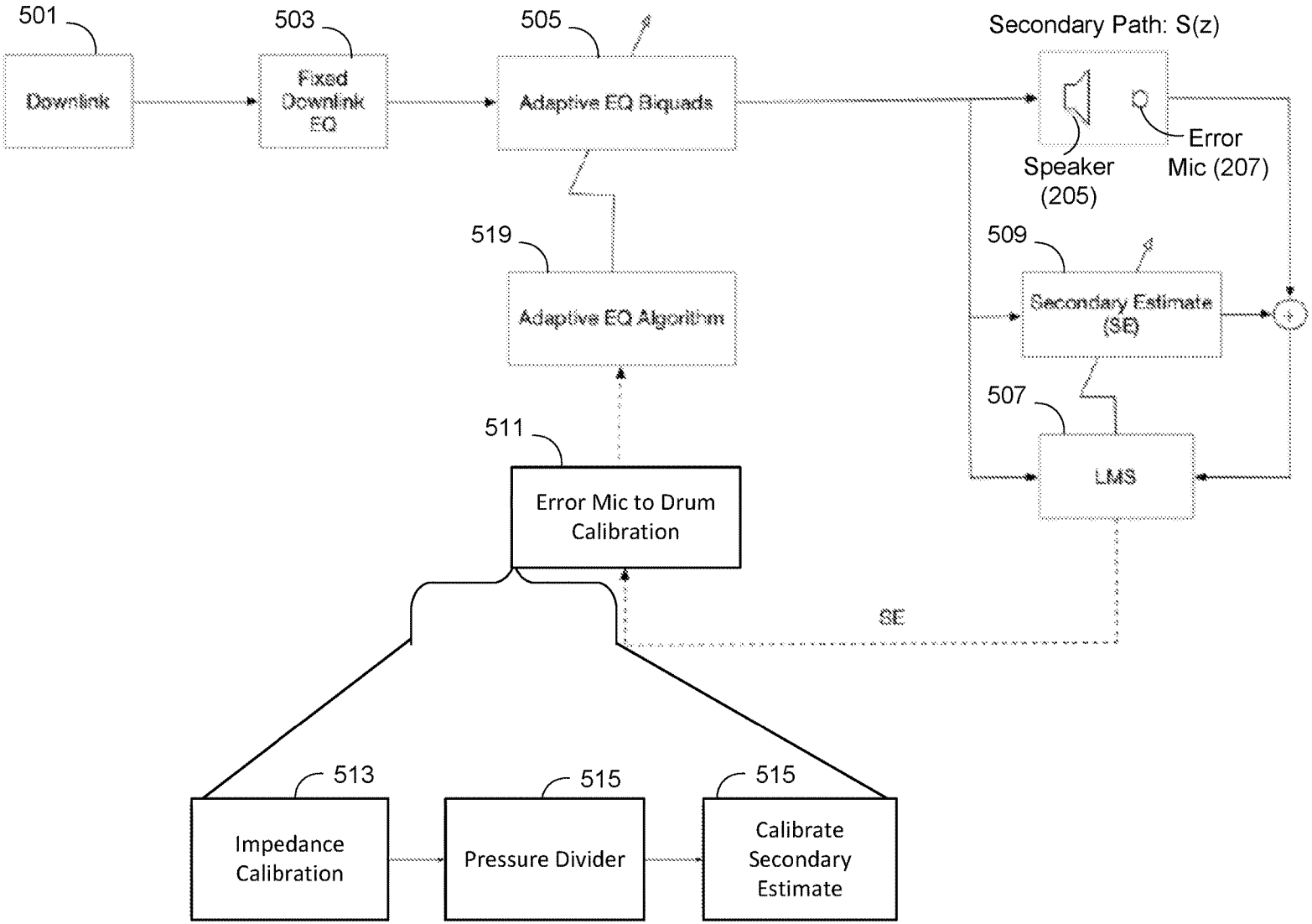
FIG. 5 depicts a functional block diagram of the adaptive equalization when the transfer function of the secondary path from the speaker to the error microphone is adjusted to compensate for the mismatch between the frequency response at the error microphone and at the eardrum due to the leakage effects according to one aspect of the disclosure.

FIG. 5 depicts a functional block diagram of the adaptive equalization when the transfer function of the secondary path from the speaker to the error microphone is adjusted to compensate for the mismatch between the frequency response at the error microphone and at the eardrum due to the leakage effects according to one aspect of the disclosure.

An earphone may receive downlink audio signal 501 such as streaming media content for playback, responses from voice queries, voice communication signals of remote parties in telephony or video calls received over a communication network, etc. The earphone may apply a fixed filter 503 to audio signal 501 as part of the adaptive equalization operation to equalize the frequency response of audio signal 501 at error microphone 207 across the range of audio frequencies. The adaptive equalization operation may include applying one of a set of biquad filters 505 based on an adaptive equalization algorithm. The biquad filters may adjust the gain of the audio signal 501 to compensate for changes in the transfer function of the secondary path from speaker 205 to error microphone 207.

A least mean-squared (LMS) controller 507 may adapt to an error term (e.g., to minimize the error term in the least mean-squared sense) derived from the signal detected by error microphone 207 and a current estimate of the transfer function of the secondary path to update the transfer function of the secondary path, referred to the secondary estimate 509. An adaptive equalization controller 519 running the adaptive equalization algorithm may adaptively select the biquad filters 505 to adjust the gain of audio signal 501 based on the secondary estimate from LMS controller 507. For example, adaptive equalization controller 519 may select a biquad filter that matches the inverse of the secondary estimate to flatten the overall frequency response. To compensate for the mismatch in the frequency response between error microphone 207 and at the eardrum due to the leakage effects, an error microphone to eardrum calibration module 511 may adjust the secondary estimate from LMS controller 507. The error microphone to eardrum calibration module may include an impedance calibration module 513, a pressure divider module 515, and a calibrate secondary estimate module 515.

In one aspect, impedance calibration module 513 may estimate the load impedance encountered by the acoustic pressure of the signal propagating into the ear canal from error microphone 207 based on the secondary estimate. The relationship between the secondary estimate and the load impedance may be calibrated through offline measurements or simulations such as during product development, in a power-up cycle, before activating the adaptive equalization, etc. Based on the calibrated relationship, impedance calibration module 513 may estimate the load impedance from the secondary estimate. For load impedance in the low frequencies that are dominated by the impedance of the parasitic leakage paths, the estimated load impedance may be used as an approximation of the impedance of the parasitic leakage paths. For load impedance in the high frequencies that are dominated by the impedance of the ear canal and the eardrum, the estimated load impedance may be used as an approximation of the impedance of the ear canal and the eardrum.

A pressure divider module 515 may estimate the acoustic pressure of the signal at the eardrum for low frequencies based on the estimated load impedance and the acoustic pressure of the signal measured by error microphone 207. In one aspect, pressure divider module 515 may estimate the acoustic pressure of the signal at the eardrum or the ratio of the acoustic pressure at the eardrum over that at error microphone 207 using Eq. 2 based on the estimated load impedance and the impedance of the housing mesh. In one aspect, pressure divider module 515 may estimate the acoustic pressure of the signal at the eardrum for high frequencies based on the estimated load impedance, the estimated impedance of the parasitic leakage path and the acoustic pressure of the signal measured by error microphone 207.

A calibrate secondary estimate module 517 may adjust the secondary estimate based on the difference between the estimated acoustic pressure of the signal at the eardrum and the measured acoustic pressure of the signal at error microphone 207 to compensate for the difference in the frequency response of the signal at the eardrum and at the error microphone. For example, calibrate secondary estimate module 517 may adjust the secondary estimate based on the estimated ratio of the acoustic pressure at the eardrum over that at error microphone 207. The adjusted secondary estimate may approximate the transfer function of the signal from the speaker to the eardrum. Adaptive equalization module 519 may adaptively select the biquad filters 505 to adjust the gain of audio signal 501 based on the adjusted secondary estimate to effectively equalize the signal at the eardrum. After compensating the secondary estimate for the mismatch in the frequency response at the eardrum and at the error microphone, there is a more uniform frequency response at the eardrum from the adaptive equalization operations across a range of leakage effects.

Figure 6:
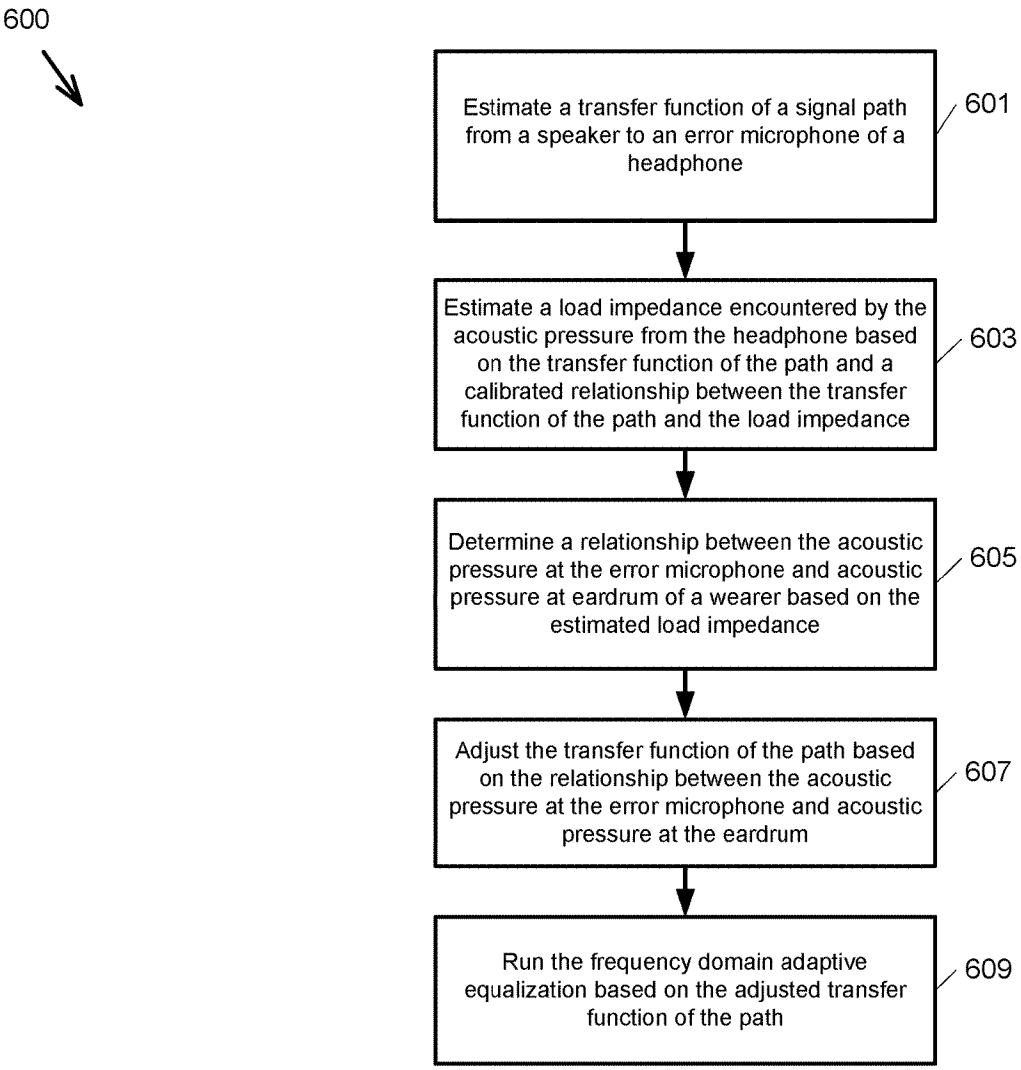
FIG. 6 is a flow diagram of a method for frequency equalization using impedance calibration to compensate for the mismatch in the frequency response at the eardrum and at the error microphone due to signal leakage effects according to one aspect of the disclosure.

FIG. 6 is a flow diagram of a method 600 for frequency equalization using impedance calibration to compensate for the mismatch in the frequency response at the eardrum and at the error microphone of the earphone due to signal leakage effects according to one aspect of the disclosure. Method 800 may be practiced by the adaptive equalization operations of FIG. 2 or FIG. 6.

In operation 601, method 600 estimates a transfer function of a signal path from a speaker to an error microphone of an earphone. The transfer function may represent the frequency response of the signal at the error microphone. An LMS controller may generate the secondary estimate based on the spectral content of the signal projected from the speaker and the spectral content of the signal received at the error microphone.

In operation 603, method 600 estimates the load impedance encountered by the acoustic pressure of the signal from the earphone based on the transfer function of the signal path and a calibrated relationship between the transfer function and the load impedance. The calibrated relationship between the transfer function and the load impedance may be calibrated through offline measurements or simulations such as during product development, in a power-up cycle, before activating the adaptive equalization, etc.

In operation 605, method 600 determines a relationship between the acoustic pressure at the error microphone and the acoustic pressure at the eardrum of a wearer of the earphone based on the estimated load impedance. In one aspect, operation 605 may estimate the acoustic pressure of the signal at the eardrum or the ratio of the acoustic pressure at the eardrum over that at error microphone using a pressure divider based on the estimated load impedance and the impedance of the housing mesh at the tip of the earphone through which the signal propagates from the error microphone into the ear canal of the wearer.

In operation 607, method 600 adjusts the transfer function of the path based on the relationship between the acoustic pressure at the error microphone and the acoustic pressure at the eardrum. In one aspect, operation 607 may adjust the transfer function from the speaker to the error microphone based on the estimated ratio of the acoustic pressure at the eardrum over that at error microphone to compensate for the difference in the frequency response of the signal at the eardrum and at the error microphone. The adjusted transfer function may approximate the transfer function of the signal from the speaker to the eardrum.

At operation 609, method 600 applies the adjusted transfer function to the adaptive equalization operation. In one aspect, operation 609 may adjust the gain of the signal based on the adjusted transfer function to effectively equalize the signal at the eardrum.

Figure 7:
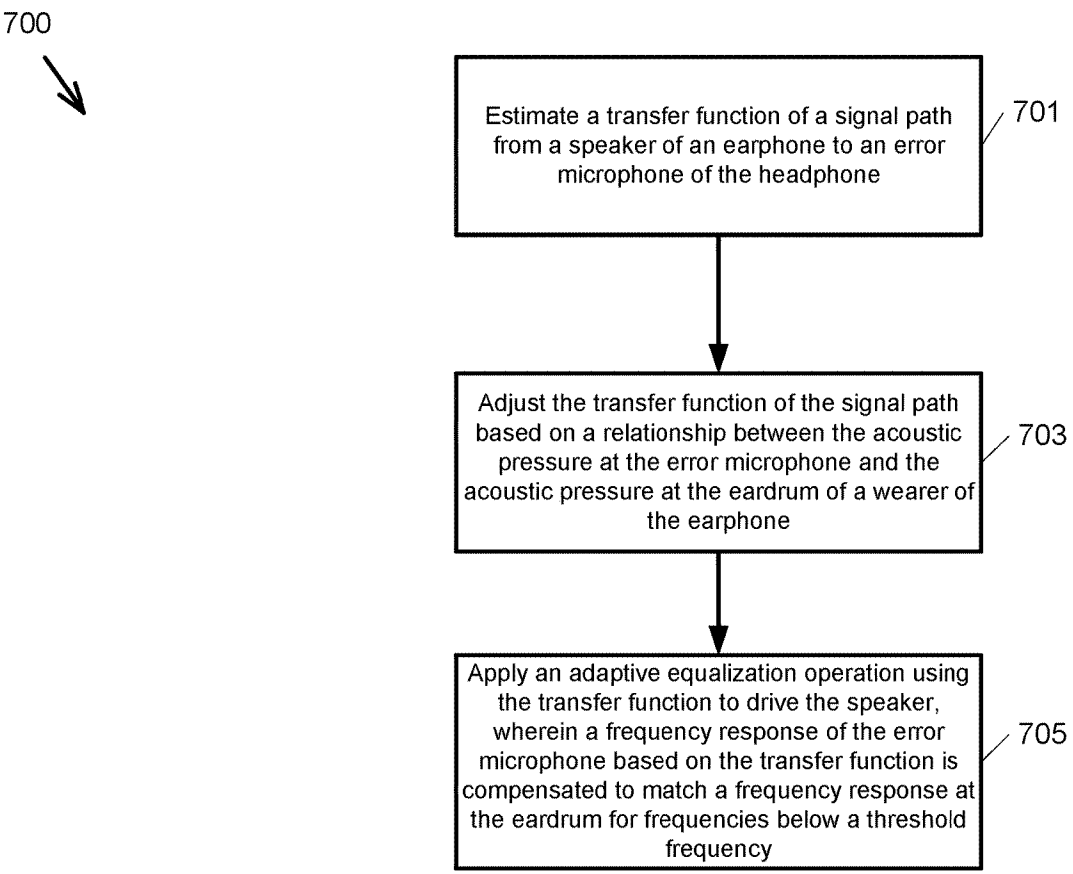
FIG. 7 is a flow diagram of another method 700 for frequency equalization using impedance calibration to compensate for the mismatch in the frequency response at the eardrum and at the error microphone of the earphone due to signal leakage effects according to one aspect of the disclosure.

FIG. 7 is a flow diagram of another method 700 for frequency equalization using impedance calibration to compensate for the mismatch in the frequency response at the eardrum and at the error microphone of the earphone due to signal leakage effects according to one aspect of the disclosure. Method 700 may be practiced by the adaptive equalization operations of FIG. 2 or FIG. 6.

In operation 701, method 700 estimates a transfer function of a signal path from a speaker of an earphone to an error microphone of an earphone. The transfer function may represent the frequency response of the signal at the error microphone. An LMS controller may generate the secondary estimate based on the spectral content of the signal projected from the speaker and the spectral content of the signal received at the error microphone.

In operation 703, method 700 adjusts the transfer function of the path based on a relationship between the acoustic pressure at the error microphone and the acoustic pressure at the eardrum of a wearer of the earphone. In one aspect, operation 703 may adjust the transfer function from the speaker to the error microphone based on the estimated ratio of the acoustic pressure at the eardrum over that at error microphone to compensate for the difference in the frequency response of the signal at the eardrum and at the error microphone.

In operation 705, method 700 applies the adaptive equalization operation using the transfer function to drive the speaker. The result is that the frequency response of the error microphone based on the transfer function is compensated to match the frequency response at the eardrum for frequencies below a threshold frequency.

Embodiments of the adaptive equalization operation to compensate for the mismatch in the frequency response at the eardrum and at the error microphone due to signal leakage effects described herein may be implemented in a data processing system, for example, by a network computer, network server, tablet computer, smartphone, laptop computer, desktop computer, other consumer electronic devices or other data processing systems. In particular, the operations described for determining the best communication mode for use by a wearable audio output device are digital signal processing operations performed by a processor that is executing instructions stored in one or more memories. The processor may read the stored instructions from the memories and execute the instructions to perform the operations described. These memories represent examples of machine readable non-transitory storage media that can store or contain computer program instructions which when executed cause a data processing system to perform the one or more methods described herein. The processor may be a processor in a local device such as a smartphone, a processor in a remote server, or a distributed processing system of multiple processors in the local device and remote server with their respective memories containing various parts of the instructions needed to perform the operations described.

The processes and blocks described herein are not limited to the specific examples described and are not limited to the specific orders used as examples herein. Rather, any of the processing blocks may be re-ordered, combined or removed, performed in parallel or in serial, as necessary, to achieve the results set forth above. The processing blocks associated with implementing the audio processing system may be performed by one or more programmable processors executing one or more computer programs stored on a non-transitory computer readable storage medium to perform the functions of the system. All or part of the audio processing system may be implemented as, special purpose logic circuitry (e.g., an FPGA (field-programmable gate array) and/or an ASIC (application-specific integrated circuit)). All or part of the audio system may be implemented using electronic hardware circuitry that include electronic devices such as, for example, at least one of a processor, a memory, a programmable logic device or a logic gate. Further, processes can be implemented in any combination hardware devices and software components.

While certain exemplary instances have been described and shown in the accompanying drawings, it is to be understood that these are merely illustrative of and not restrictive on the broad invention, and that this invention is not limited to the specific constructions and arrangements shown and described, since various other modifications may occur to those of ordinary skill in the art. The description is thus to be regarded as illustrative instead of limiting.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

What is claimed is:

1. A method for performing adaptive equalization operations for an earphone, the method comprising:

determining a transfer function of a signal path from a speaker of an earphone to an error microphone of the earphone;

adjusting the transfer function based on a relationship between a first acoustic pressure at the error microphone and a second acoustic pressure at an eardrum of a wearer of the earphone; and applying the adaptive equalization operations to drive the speaker, by compensating a frequency response of the error microphone based on the adjusted transfer function to match a frequency response at the eardrum for frequencies below a threshold frequency.

2. The method of claim 1, further comprising:

determining a load impedance of the earphone based on the transfer function and a calibrated relationship between the transfer function and the load impedance; and determining the relationship between the first acoustic pressure at the error microphone and the second acoustic pressure at the eardrum based on the load impedance.

3. The method of claim 2, wherein determining the relationship between the first acoustic pressure and the second acoustic pressure comprises:

determining a ratio of the second acoustic pressure over the first acoustic pressure as a ratio of the load impedance over a sum of the load impedance and an acoustic impedance of a mesh of the earphone through which the first acoustic pressure propagates to reach the eardrum for signal frequencies below the threshold frequency.

4. The method of claim 3, wherein the load impedance is predominantly determined by a parasitic impedance of a leakage path of the first acoustic pressure from an ear canal of the wearer rather than an acoustic impedance of the ear canal for frequencies below the threshold frequency.

5. The method of claim 4, wherein the parasitic impedance of the leakage path varies as a function of a fitting of the earphone against the ear canal.

6. The method of claim 2, wherein the calibrated relationship between the transfer function and the load impedance is predetermined through measurements using a plurality of values of a parasitic impedance of one or more leakage paths of the first acoustic pressure from an ear canal of the wearer.

7. The method of claim 2, wherein determining the relationship between the first acoustic pressure and the second acoustic pressure comprises:

determining a ratio of the second acoustic pressure over the first acoustic pressure as a function of the load impedance and a model of an ear canal of the wearer for signal frequencies above the threshold frequency.

8. The method of claim 7, wherein the load impedance is predominantly determined by an acoustic impedance of the ear canal over a parasitic impedance of a leakage path of the first acoustic pressure from the ear canal of the wearer for frequencies above the threshold frequency.

9. The method of claim 1, wherein the threshold frequency comprises 1 KHz.

10. The method of claim 1, wherein adjusting the transfer function comprises:

adjusting the transfer function based on a ratio of the second acoustic pressure over the first acoustic pressure to compensate for a difference between the second acoustic pressure and the first acoustic pressure, wherein the second acoustic pressure is less than the first acoustic pressure.

11. A processor of an earphone, the processor configured to perform adaptive equalization operations comprising operations to:

determine a transfer function of a signal path from a speaker of an earphone to an error microphone of the earphone;

adjust the transfer function based on a relationship between a first acoustic pressure at the error microphone and a second acoustic pressure at an eardrum of a wearer of the earphone; and apply the adaptive equalization operations to drive the speaker, by compensating a frequency response of the error microphone based on the adjusted transfer function to match a frequency response at the eardrum for frequencies below a threshold frequency.

12. The processor of claim 11, wherein the operations further comprise:

determine a load impedance of the earphone based on the transfer function and a calibrated relationship between the transfer function and the load impedance; and determine the relationship between the first acoustic pressure at the error microphone and the second acoustic pressure at the eardrum based on the load impedance.

13. The processor of claim 12, wherein to determine the relationship between the first acoustic pressure and the second acoustic pressure, the operations further comprise:

determine a ratio of the second acoustic pressure over the first acoustic pressure as a ratio of the load impedance over a sum of the load impedance and an acoustic impedance of a mesh of the earphone through which the first acoustic pressure propagates to reach the eardrum for signal frequencies below the threshold frequency.

14. The processor of claim 13, wherein the load impedance is predominantly determined by a parasitic impedance of a leakage path of the first acoustic pressure from an ear canal of the wearer rather than an acoustic impedance of the ear canal for frequencies below the threshold frequency.

15. The processor of claim 12, wherein the calibrated relationship between the transfer function and the load impedance is predetermined through measurements using a plurality of values of a parasitic impedance of one or more leakage paths of the first acoustic pressure from an ear canal of the wearer.

16. The processor of claim 12, wherein to determine the relationship between the first acoustic pressure and the second acoustic pressure, the operations further comprise:

determine a ratio of the second acoustic pressure over the first acoustic pressure as a function of the load impedance and a model of an ear canal of the wearer for signal frequencies above the threshold frequency.

17. The processor of claim 16, wherein the load impedance is predominantly determined by an acoustic impedance of the ear canal over a parasitic impedance of a leakage path of the first acoustic pressure from the ear canal of the wearer for the signal frequencies above the threshold frequency.

18. The processor of claim 11, wherein the threshold frequency comprises 1 KHz.

19. The processor of claim 11, wherein to adjust the transfer function, the operations further comprise:

adjust the transfer function based on a ratio of the second acoustic pressure over the first acoustic pressure to compensate for a difference between the second acoustic pressure and the first acoustic pressure, wherein the second acoustic pressure is less than the first acoustic pressure.

20. An earphone comprising:

a speaker configured to transmit a signal;

an error microphone configured to capture the signal transmitted by the speaker as a first acoustic pressure;

a processor; and a memory coupled to the processor to store instructions, which when executed by the processor, cause the processor to perform adaptive equalization operations comprising:

determine a transfer function of a signal path from the speaker to the error microphone;

adjust the transfer function based on a relationship between the first acoustic pressure at the error microphone and a second acoustic pressure at an eardrum of a wearer of the earphone; and apply the adaptive equalization operations to drive the speaker by compensating a frequency response of the error microphone based on the adjusted transfer function to match a frequency response at the eardrum for frequencies below a threshold frequency.

* * * * *